US007387070B1

(12) United States Patent
Mydlack et al.

(10) Patent No.: US 7,387,070 B1
(45) Date of Patent: Jun. 17, 2008

(54) METHOD AND APPARATUS FOR AUTOMATIC INDEXING OF A GOLF BALL

(75) Inventors: Thomas L. Mydlack, Rochester, MA (US); Edmund T. Maher, Fairhaven, MA (US); Michael F. Vieira, Acushnet, MA (US); Thomas N. Schermerhorn, Holliston, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/832,127

(22) Filed: Aug. 1, 2007

(51) Int. Cl.
*B41F 17/34* (2006.01)

(52) U.S. Cl. ..... 101/492; 101/493; 101/35; 101/407.1; 101/DIG. 40; 101/41

(58) Field of Classification Search ..... 101/35, 101/41, DIG. 40
See application file for complete search history.

(56) References Cited

U.S. PATENT DOCUMENTS

| | | | | |
|---|---|---|---|---|
| 5,777,244 | A | 7/1998 | Kumagai et al. | |
| 5,859,923 | A | 1/1999 | Petry, III et al. | |
| 6,031,933 | A | 2/2000 | Kumagai | |
| 6,061,086 | A | 5/2000 | Reimer et al. | |
| 6,462,812 | B1 | 10/2002 | Heene et al. | |
| 6,490,968 | B2 | 12/2002 | Lutz et al. | |
| 6,630,998 | B1 | 10/2003 | Welchman et al. | |
| 6,705,217 | B1 * | 3/2004 | Godsey et al. | 101/35 |
| 6,809,822 | B2 | 10/2004 | Welchman et al. | |
| 6,825,931 | B2 | 11/2004 | Welchman et al. | |
| 6,839,138 | B2 | 1/2005 | Welchman et al. | |
| 6,923,115 | B1 * | 8/2005 | Litscher et al. | 101/35 |
| 7,048,651 | B2 | 5/2006 | Kennedy, III et al. | |
| 7,162,070 | B2 | 1/2007 | Furze et al. | |
| 7,283,657 | B1 * | 10/2007 | Carlson | 382/141 |
| 2005/0132909 | A1 | 6/2005 | Lutz | |
| 2005/0202886 | A1 | 9/2005 | Furze et al. | |
| 2006/0005718 | A1 | 1/2006 | Ohira | |
| 2006/0065137 | A1 | 3/2006 | Nguyen et al. | |
| 2006/0196372 | A1 | 9/2006 | Kennedy, III et al. | |

* cited by examiner

*Primary Examiner*—Leslie J Evanisko
(74) *Attorney, Agent, or Firm*—D. Michael Burns

(57) ABSTRACT

A method and apparatus for applying printing of indicia and logo to golf balls held and indexed by magnetic indexing devices connected to a conveyor. The device includes a stationary base portion and a rotating cup portion which are magnetically coupled to each other. Each portion has recesses for housing magnets to create a magnetic field of attraction which firmly locks the two portions together. When rotation of the cup portion to the base portion is required, the rotation is substantially friction-free because of a thrust bearing ring set in the base portion. The cup portion is caused to rotate 45° or 90° upon being biasly urged by station locks located on the conveyor. The cup portion has an open bridge section wherein cam surfaces of the station locks can engage and cause the cup portion to rotate, which is necessary for each new procedure, whether it be inspection of the ball, pad printing of indicia and logo, or curing the printed ink with ultraviolet light.

11 Claims, 9 Drawing Sheets

* Indicates position of station locks

METHOD AND APPARATUS FOR AUTOMATIC INDEXING OF A GOLF BALL

FIELD OF THE INVENTION

This invention generally relates to a method for indexing a golf ball for the purpose of printing indicia. This invention more particularly relates to a method that employs a plurality of station locks that automatically index magnetically held golf balls for pad printing of indicia.

BACKGROUND OF THE INVENTION

More than seven hundred million golf balls are produced each year, a significant percentage of which have indicia or logos printed on their outer surface. The indicia typically include any one of the golf ball company, trade name, a number, or an image, such as a corporate or country club logo. The indicia are typically printed on a base-coated surface of the cover of the golf ball, and covered with a top-coating to prevent damage during impact with a golf club. Thus, the indicia must have a perfect appearance since it is often the most distinctive quality of a golf ball.

The golf ball cover typically contains a white or other colored concentrate, or is painted. The most common method for adding a logo to the dimpled surface of a golf ball is by pad printing, although other methods, such as inkjet printing, are adaptable for such surfaces. However, whatever method is used the golf ball must be first, oriented for the printing step(s), secondly, they must be printed on at least three sides, preferably four, and finally, there must be a method of inspection for those golf balls, which during the process have a flaw or defect in the printing.

There has been a continuing desire to achieve high production rates. Because automated apparatus typically may function faster than human operators, there has been an ongoing goal to reduce, if not eliminate, human intervention during the manufacturing process. Thus, each of the above processes is typically done at a separate automated processing station functioning at optimal efficiency and speed so that the overall production rate is maintained at the desired high level. For instance, pad-printing apparatus preferably includes an array of print-pads arranged to apply a production print sequentially on various locations on the surface of the golf ball, the golf ball being indexed before being passed to the next print-pad.

The pad printing process begins by spreading ink across the surface of a pad printing cliche or "plate" containing etched or depressed version of the desired image. Ink is dispersed over the etched area and excess ink is removed with a "doctor" blade or cup. Upon exposure to air, thinner evaporates from the ink causing it's surface to become "tacky." A smooth, resilient, block of silicone rubber (the "pad") is brought into contact with the tacky surface of the ink. As the pad is withdrawn from the plate surface, an adhering film of ink is transferred to the pad. The ink is carried on the pad to the target area on the golf ball surface, during which time thinner in the ink further evaporates, causing the exposed ink surface on the pad to become tacky. Upon contact with the golf ball surface, the film of ink is transferred from the pad to the ball surface.

Pad printing plates are typically stiff plates coated with a photopolymer material that cures upon exposure to UV light. The etched version of the image is formed by placing a film positive of the image over the plate and irradiating the surface with UV light. In this manner, the exposed areas of the plate harden, while blocked areas remain soft. The soft polymer is then removed by a series of washing steps, creating etched areas correlating to the logo.

While the golf industry needs improvement in automatically orienting, printing and inspecting golf balls produced by high speed production lines, the challenge is in the indexing of the golf ball such that multiple surfaces of the ball are presented sequentially and with extreme precision to the pad printers for the printing of indicia without interrupting the production cycle. This requires accurate indexing of the ball and the maintaining of that index.

SUMMARY OF THE INVENTION

The present invention is directed to a method and apparatus for printing indicia and logo on a golf ball held in position on a conveyor by a magnetic indexing device that allows the ball to be rotated (indexed) for the purpose of exposing multiple surface areas to pad print heads that use UV curable ink. The device has means to cooperate with transfer mechanisms, slide mechanisms and station locks that are part of the conveyor.

A key component of the apparatus is a magnetic indexing device which is comprised of a stationary base portion which is affixed to a conveyor, and a rotating cup portion which is connected by a magnetic field to the base portion. Each portion has recesses for housing magnets that therein create the magnetic field of attraction which firmly holds the two portions together. When rotation of the cup portion to the base portion is required, the rotation is substantially friction-free because of a ball bearing ring set in the base portion. The cup portion is caused to rotate 45° or 90° upon being biasly urged by station locks located on the conveyor. The cup portion has an open bridge section wherein cam surfaces of the station locks can engage and cause the cup portion to rotate, which is necessary for each new procedure, whether it be inspection of the ball, pad printing of indicia and logo, or curing the printed ink with ultraviolet light.

Golf balls that have indicia printed on them using the method of the present invention are placed into the system in a bulk quantity. Each ball is oriented by an imaging station that uses software to load a complete pattern trajectory to a computer with a single communications transaction via Ethernet. Upon the ball being properly oriented, a transfer mechanism picks the oriented ball up and deposits it into a hemispherical cavity of a device attached to a sled on the conveyor, all while maintaining a precise predetermined relationship between the ball and the cavity, wherein the ball is firmly held in the cavity by a pair of fingers. To allow access of the ball into the hemispherical cavity, parallel sliders operate in tandem to push open the fingers to allow the depositing of the ball. The golf ball remains oriented in the cavity for the entire printing process, and since it is the cup portion of the device that is rotated, various surfaces of the ball are exposed for printing. The pad printing of indicia may include player number, brand, source of origin, logo, etc.

An object of the present invention is to reduce or eliminate wear and tear on a high speed conveyor line where all movement is automatically generated. The apparatus provides for virtual frictionless rotation to reduce any mechanical wear by having the rotation glide over a thrust bearing ring. Multiple station locks, which are located along the conveyor, engage the indexing device and cause the cup portion to rotate (index) therein exposing a new surface for either printing, inspection, or curing. To maintain the cup in position between station locks is the function of the magnets that are disposed in the device. Magnets in the stationary base portion of the device develop a magnetic field with the magnets located in the rotating cup portion. As the devices move along the conveyor, each station lock has an engaging cam section to mesh with an open bridge section of the device to rotate it from a prior position to the next position. At the next position, printing, inspection, or curing procedures are performed, all while the station lock holds the cup device in position. Upon completion of the procedure, the station locks release the device to move along the conveyor line for the next procedure. It is the magnetic forces of the device that hold the rotating cup portion securely to the base portion. Since the device is without any mechanical locking parts, it is the magnetic force of the magnets that firmly holds the rotating portion to the base portion.

The ball held by the device is subjected to printing by multiple articulated pad print heads that employ UV curable inks supplied to each print head by a fully integrated ink viscosity control system, and the inspection of all printed sites of the ball is performed by a vision print quality inspection system which removes from the conveyor line any ball failing the inspection. A UV curing system is utilized to dry the ink. Whether it is to expose a ball surface for printing, to expose a surface for inspection, to expose a surface for curing, or to place the ball in position for removal from the conveyor, each step requires the device to be indexed by a station lock and subsequently held in place by the magnets between station lock positions.

BRIEF DESCRIPTION OF THE DRAWINGS

In the accompanying drawings, which form a part of the specification and are to be read in conjunction therewith and in which like reference numerals are used to indicate like parts in the various views, the drawings are.

DETAILED DESCRIPTION OF THE PREFERRED EMBODIMENTS

Figure 1:
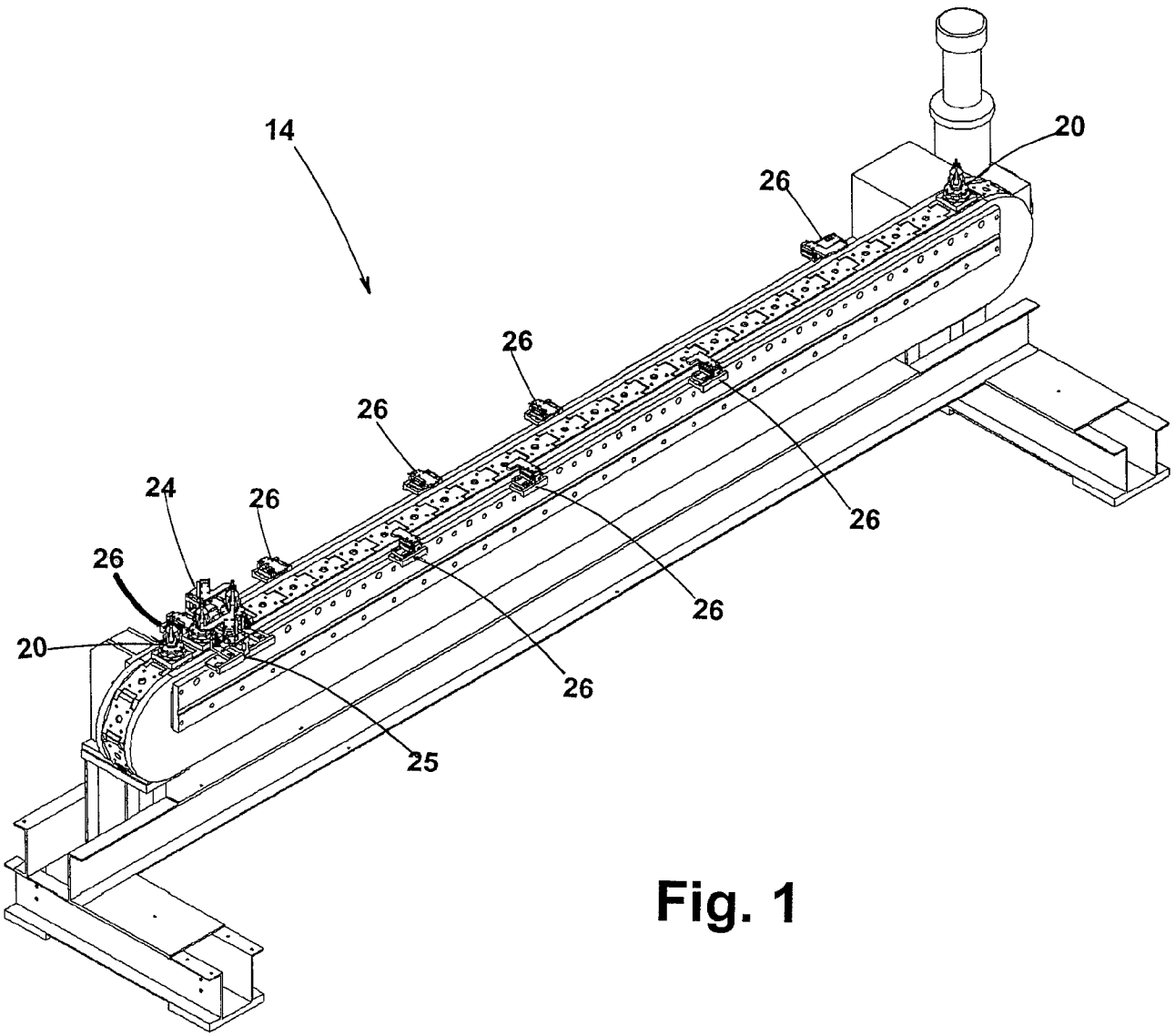
FIG. 1 is a perspective view of a conveyor illustrating the positions of the station locks and slide devices.

As illustrated in the accompanying drawings and discussed in detail below, one embodiment of the present invention is directed to a method and apparatus for printing golf balls with indicia and logo utilizing multiple magnetic indexing devices 20 that firmly hold golf balls in place for the printing. Multiple indexing devices 20 are each secured to a sled 28 on an endless conveyor 14, as shown on FIG. 1. While moving along the conveyor 14, each device 20 is precisely rotated (indexed) such that each and every held ball has the exact same surfaces exposed to multiple articulated pad printers 16 which print indicia and logo thereupon. The balls are also indexed for inspection, curing of the ink, and removal from the device 20.

Figure 3:
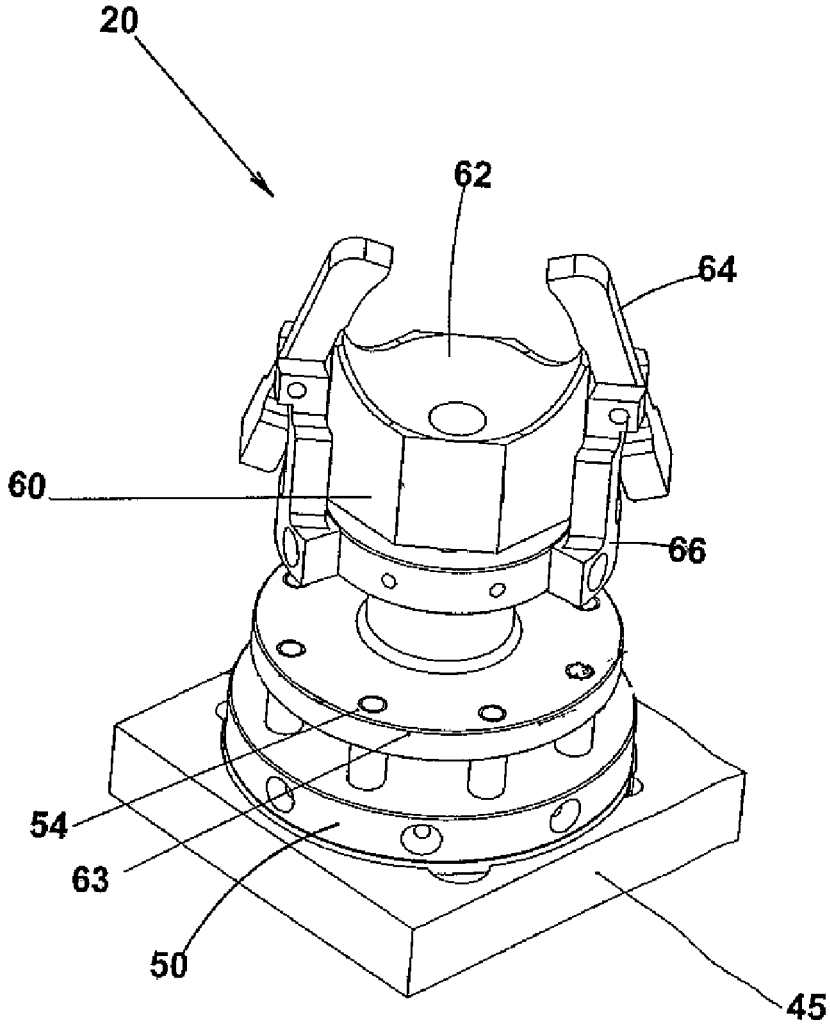
FIG. 3 is a perspective view of the magnetic indexing device of the present invention.
Figure 4:
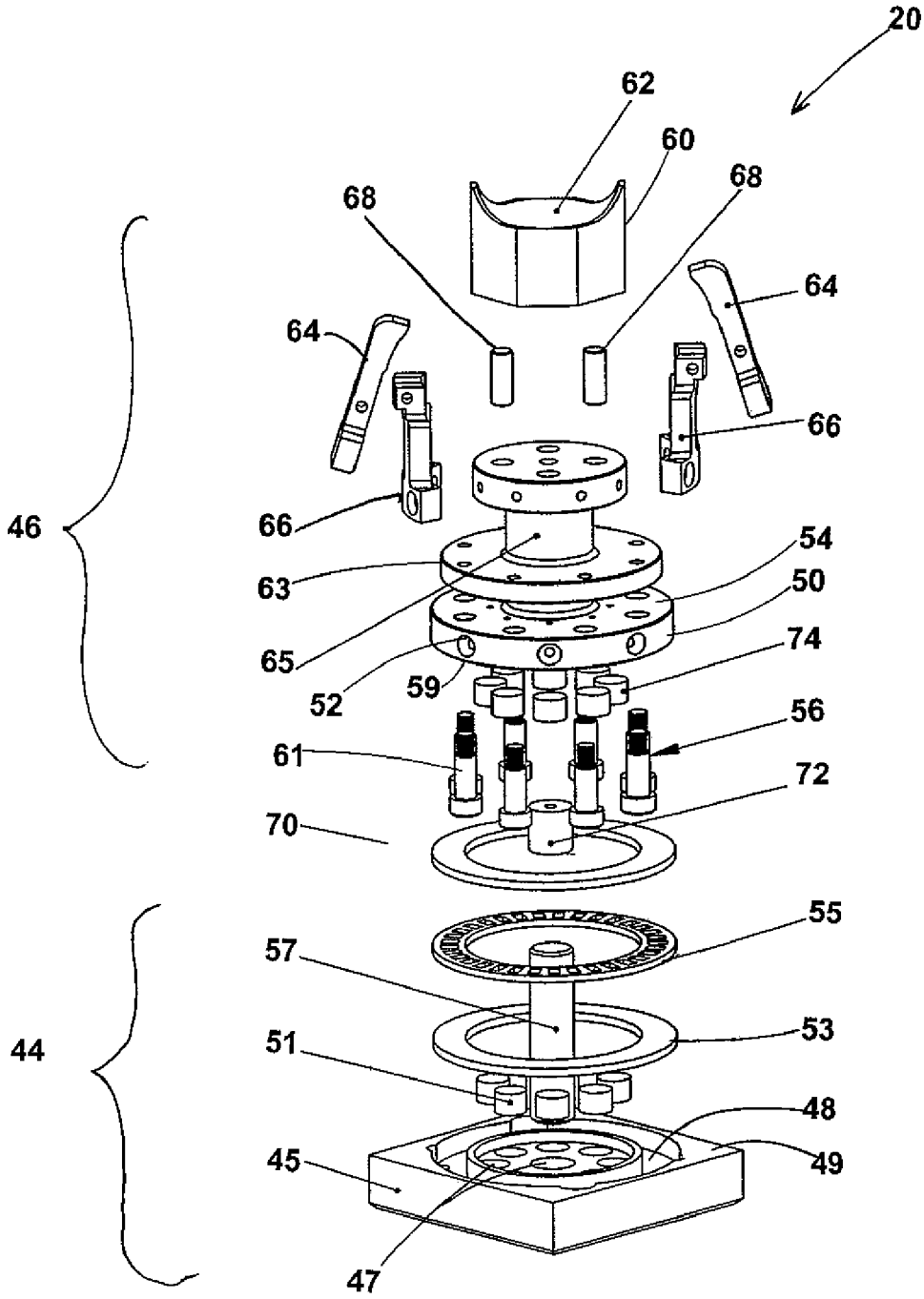
FIG. 4 is an expanded view of the device shown in FIG. 3.
Figure 5:
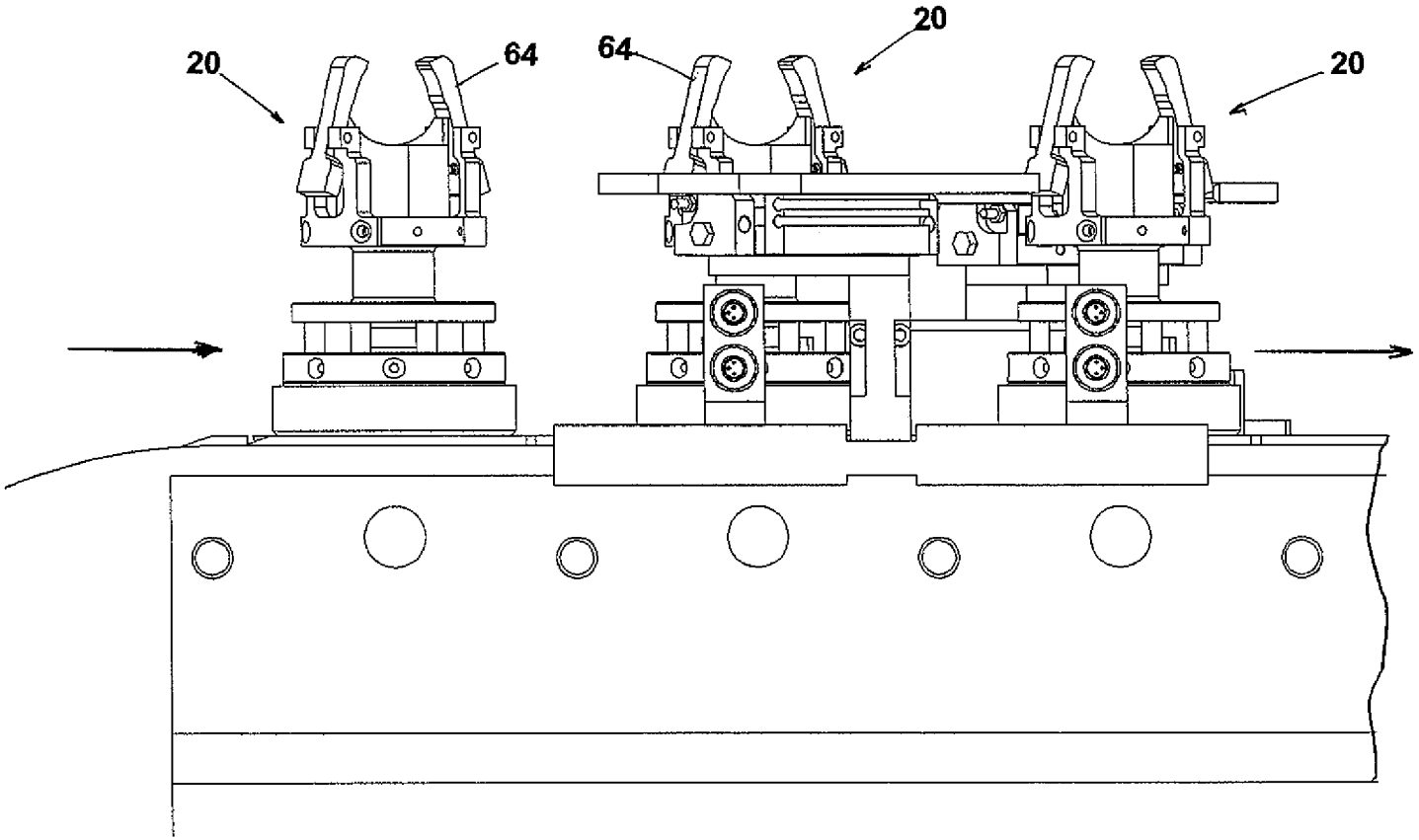
FIG. 5 is an elevational side view of a plurality of the devices while moving down the conveyor line.
Figure 6:
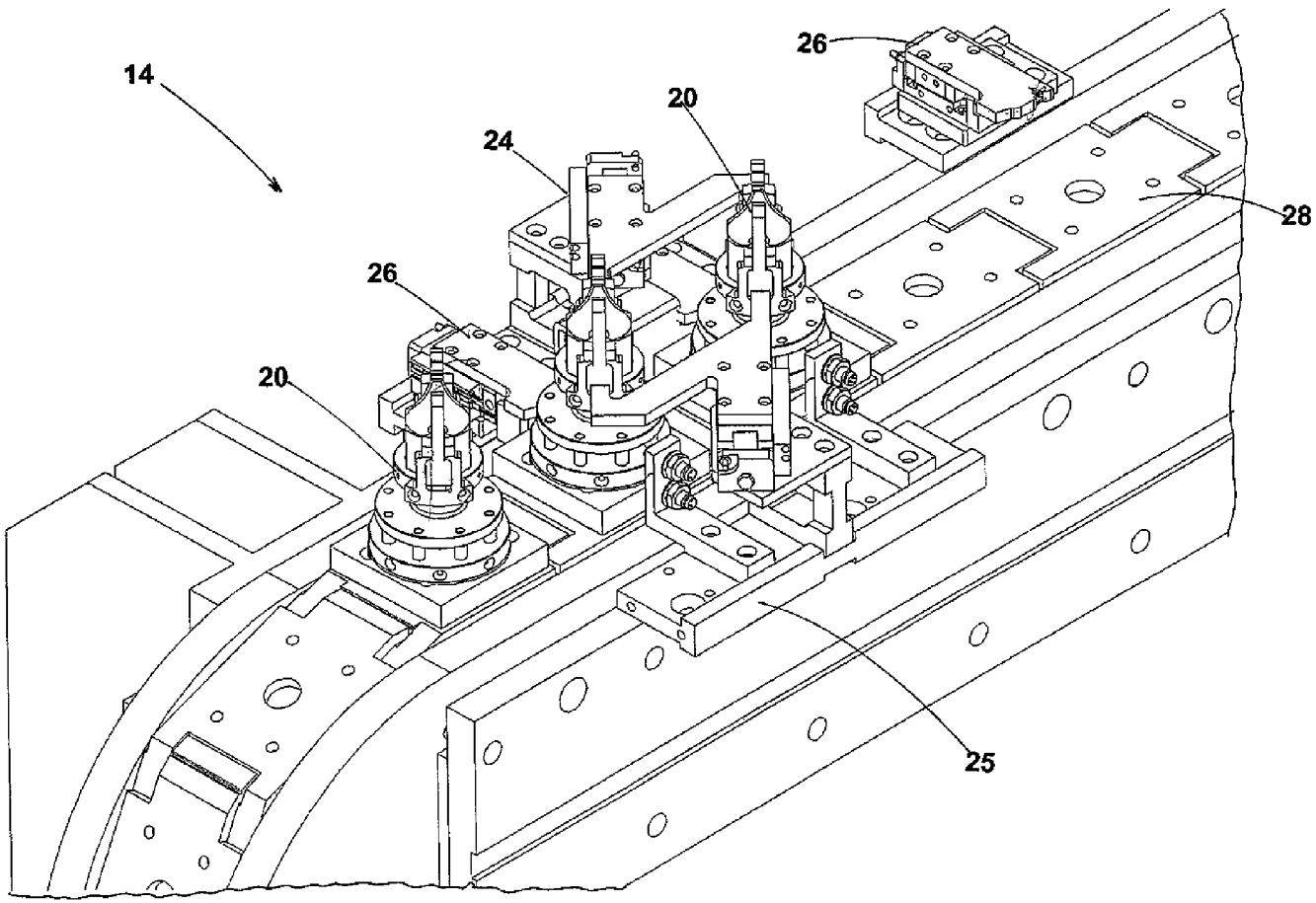
FIG. 6 is a perspective top view of a segment of the conveyor line apparatus that includes the magnetic device of the present invention with station locks to provide for horizontally indexing of the device and sliders for opening the cups for the depositing of golf balls.
Figure 7:
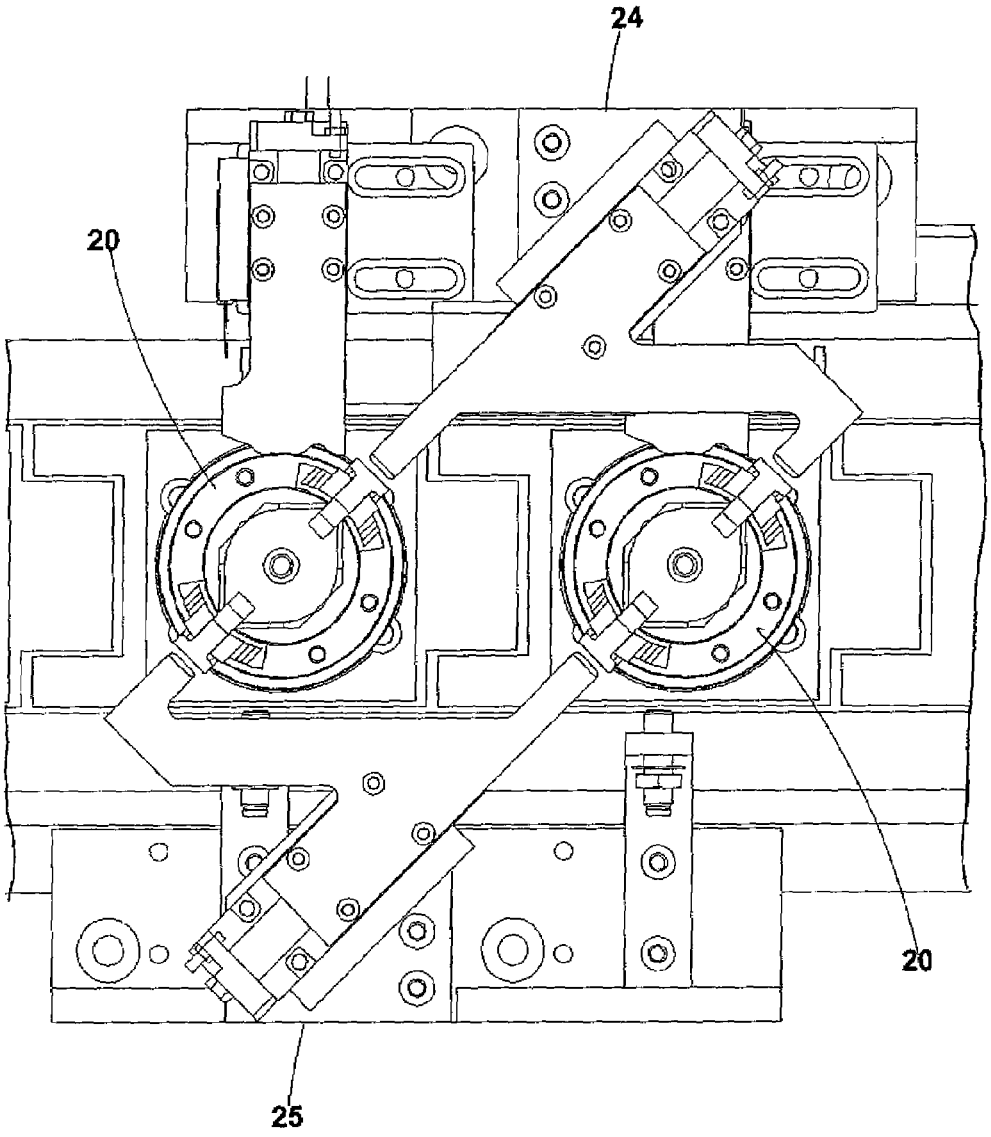
FIG. 7 is a top plan view of the device of the present invention as it engages the station lock and the sliders.
Figure 8:
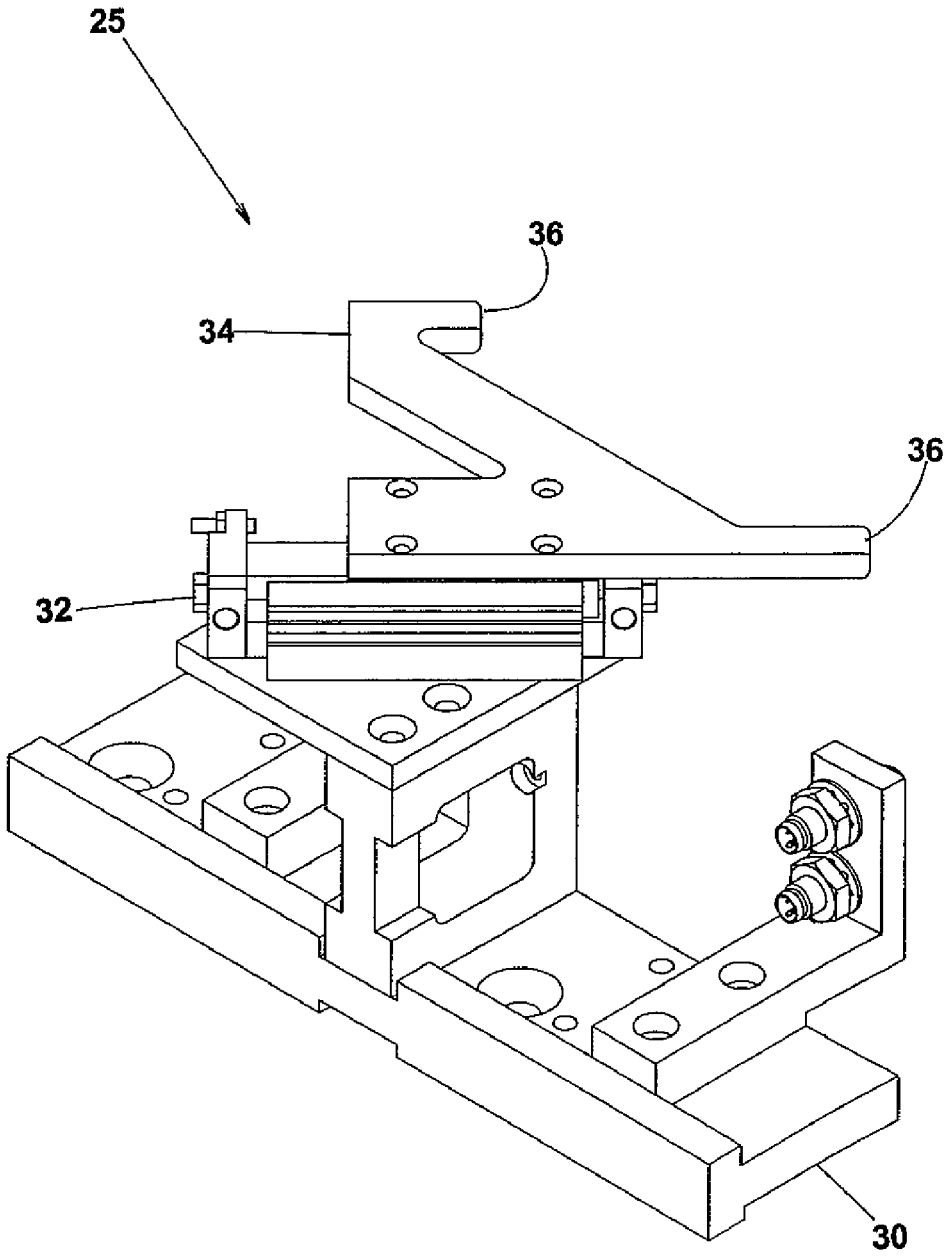
FIG. 8 is a perspective view of one of the slider members.

As best shown in FIGS. 3 and 4, the device 20 includes two cooperating portions, a stationary base portion 44 and a rotating cup portion 46.

The stationary base portion 44 comprises; a square platform 45 that is mechanically connected to the conveyor sled 28 by well known means such as bolting the platform to a conveyor sled 28 that is integral with the conveyor 14; a plurality of recesses 47 are defined in the upper surface 49 of the platform 45, preferably eight (8), for seating a plurality of bottom magnets 51 with the north poles of the magnets facing upwards; a circular channel 48 is defined on the top surface 49 of the platform 45; a bottom metallic washer ring 53 is seated in the channel 48 and held in place by the magnetic force generated by the bottom magnets 51; thrust bearing ring 55 is juxtaposed on top of the bottom washer ring 53 and it also is held by the magnetic force; and, an alignment pin 57 that is integral with the platform 45 and extends upwards to align the stationary base portion 44 to the rotating cup portion 46 when the two portions are brought together.

The rotating cup portion 46 comprises: a lower circular member 50, of a size and shape to be a positioned in the channel 48 of the base portion 44; the lower circular member 50 having a bottom surface 59 defining a plurality of recesses (not shown) for housing a corresponding number of top magnets 74, the south poles of which face downwards to create a magnetic locking force between the base and cup portions 44, 46; a plurality of threaded ports 52 are spaced about the outer perimeter of the lower circular member 50 for receiving tightening bolts which help secure the top magnets 74 in place; a circular aperture (not shown) is defined through the center of the rotating cup portion 46 for housing a bushing 72 which mates with the alignment pin 57 of the base portion 44 to facilitate joining the two portions 44 and 46; a circular upper member 63 supports the main body 65 of the rotating cup portion 46; the upper member 63 is connected to the lower circular member 50 by a plurality of shoulder bolts 56, preferably at least 8, which are threaded into the bottom surface of the upper member 63 and in which the unthreaded sections 61 cooperatively provide spacing between the lower and upper circular members 50, 63 to create a bridge-like opening 54 (shown on FIG. 3), the function for which is described later; a hemispherical cavity cup 60 is friction fitted by dowel pins 68 to the main body 65; the cavity cup 60 having an inner surface 62 defining a reverse golf ball dimple pattern of the golf ball being processed; means for holding an oriented golf ball in place, the means include a pair of opposing flexible fingers 64 connected to the hemispherical cavity cup 60 and supported by a pair of brackets 66. The fingers 64 are pushed apart by a pair of sliders, a left slider 24 which is on the left side of the conveyor in relationship to the conveyor travel and a right slider 25 that is on the right side of the conveyor; a metallic top washer 70 that is held by magnetic force to the bottom surface 59 of the lower circular member 50 is juxtaposed against the top surface of the thrust bearing ring 55 therein magnetically locking the base and rotating cup portions 44, 46 to each other. When the rotating cup portion 46 is indexed in relationship to the base portion 44, the freedom of movement is aided by the thrust bearing ring 55 which creates a virtual frictionless rotation. Without the magnetic field, the two portions 44, 46 would spin free in relationship to each other.

Figure 2:
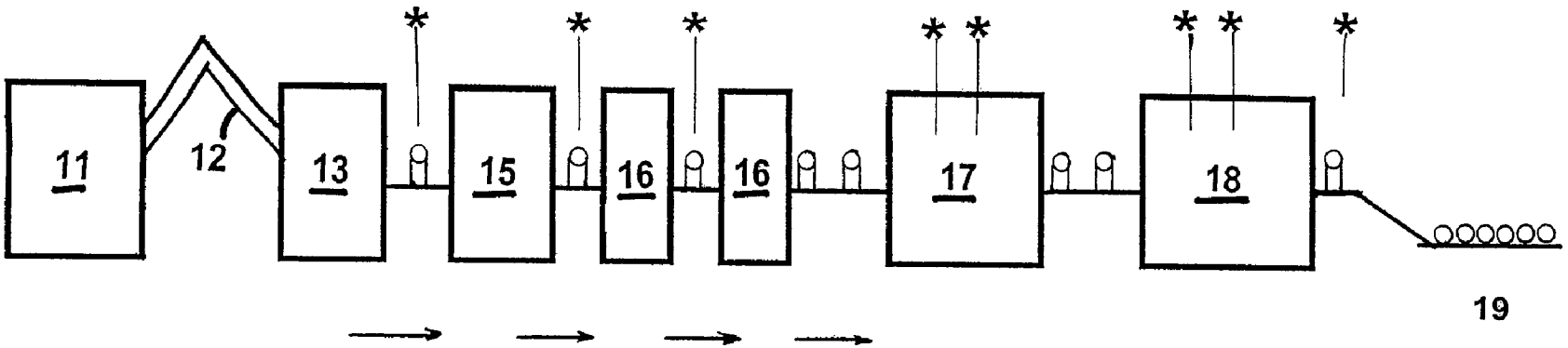
FIG. 2 is a schematic side view of a conveyor line apparatus that employs the cup device of the present invention.
Figure 9:
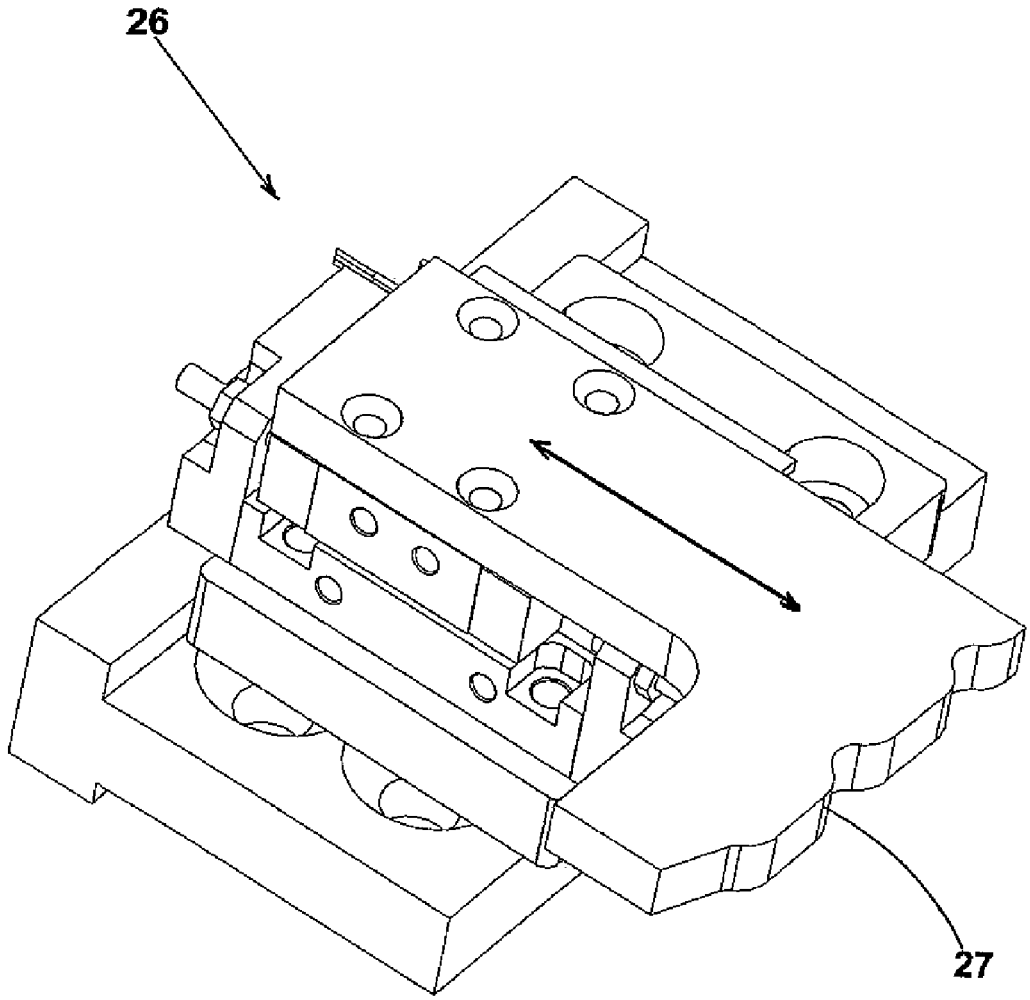
FIG. 9 is a perspective view of a station lock mechanism.

The apparatus 10, as shown on FIG. 2, includes a hopper 11 wherein a multitude of golf balls (not shown) are loaded for the purpose of being printed with indicia. The balls are automatically moved by a lifter 12 to an orientation system 13 wherein each ball is oriented by an imaging station that uses software to load a complete pattern trajectory to a computer with a single communications transaction via Ethernet. Upon each ball being properly oriented, it is individually plucked and transferred by a robotic mechanism (not shown) and deposited into the hemispherical cavity 60 of the indexing devices 20. Each device 20 is one of a plurality of devices 20 that are affixed to conveyor sleds 28, and it is the function of the device 20 to securely hold the ball in the orientation that is required for the duration of the printing process. As best shown on FIGS. 1 and 9, the conveyor 14 employs a plurality of station locks 26 (preferably eight) along the entire length of the conveyor, with each lock having an engaging cam surface 27. Each cam surface 27 can interlock with an open bridge section 54 defined in each device 20, and therein biasly break the magnetic force that holds the base and rotating portions 44, 46 together. After the open bridge section 54 intermeshes with the cam surface 27 of the station lock 26, the rotating cup portions 46 are biasly caused to be indexed to a new oriented position wherein a newly indexed ball surface is exposed to either, a printer pad, an inspection system, a UV drying system, or a removal element.

The above method requires a station lock for each indexing step. Thus, if after a first surface is printed upon, the ball must be then rotated by a station lock 26 to expose another surface for printing, and the ball must be rotated a new time for each inspection required, and the ball must further be rotated one time for each curing step. The function of the station locks 26 is to break the magnetic attraction of the cup and base portions of the device 20 and biasly rotate the cup portion 46 to a new position and securely hold the cup portion (therein the ball) for the particular process step which includes printing, inspecting, curing, and removal from the cup. The function of the magnets 51 and 74 is to hold fast the device 20 while it travels between station locks 26, otherwise as previously stated, the cup portion 46 would spin freely in relationship to the base portion 44.

The magnetic indexing device 20 is the key component to the method of printing as described above and on FIG. 2. The mechanics of the method are best shown in FIGS. 1-2, and 5 to 9. Upon the ball being properly oriented by the orientation system 13, and plucked up to be deposited into a cup cavity 60, a pair of parallel sliders, a left slider 24 and a right slider 25 operate in tandem to push open the flexible fingers 64 of the cup portion 46 therein opening the hemispherical cavity 60 to accommodate reception of a golf ball therein. As shown on FIG. 7, each slider 24, 25 has a slide base 30 anchored to the conveyor 14, with a slide table 32 mounted thereon, in which a pusher element 34 reciprocally slides back and forth and a pair of contact tips 36 engage and push the flexible fingers 64 at a low area which effectively causes the tips of the fingers 64 to spread apart and therein create an open position for the depositing of a golf ball. The robotic mechanism exactly transfers the ball from the orientation system into the cavity cup 60 without any deviation in orientation. It is imperative for the present invention that each and every type of ball be of the same orientation when presented to the pad printers 16. Prior to accepting the oriented ball, the device 20 is first indexed by a station lock 26 (FIG. 6) and after acceptance of the oriented ball, a first vision inspection system 15 verifies that the ball is properly positioned. If it is not, then it is removed at that point from the system. After passing the first vision inspection 15, the ball progresses along the conveyor 14 to the articulated pad printers 16 where two horizontal surfaces are exposed for printing indicia or logo thereupon with a UV curable ink. An option is available wherein printing can be performed on a top surface of the ball making it a total of three separate ball areas at this point. Next, if additional printing is to be done then the device is again indexed by another station lock which rotates and securely holds the ball for printing of indicia on up to two more ball surfaces. It is during the time that the device 20 moves between station locks that the magnetic force holds the cup portion 46 to the base portion 44 of the device 20. Once a golf ball is printed with indicia (e.g., labels, logos, dimples, or other markings), the indicia is inspected by a second vision inspection system 17 to ensure compliance with a prescribed set of quality standards. For each separate printing operation that was performed, the device 20 must be rotated by a station lock to allow the vision inspection system 17 to have visual access to the indicia or logo. This inspection 17 is automatically performed by a line-scan vision system connected to a computer, which analyzes whether each indicium is acceptable. The UV curable ink is exposed to a UV light source 18 for curing and once again the device 20 must be rotated by a station lock for each printing procedure in order that the indicia be in view of the UV light source. Upon completion of the curing step, the device is subject to yet another station lock which rotates the device in accordance of whether the ball is accepted or rejected. The rejected balls are removed from the system and the accepted balls are conveyed to an inspection table 19 for further processing.

The articulated pad printing system 16 utilizes ultraviolet ("UV") curable inks. UV inks are typically cured by means of UV light having wavelengths of from about 180 nm to about 380 nm. The advantages of using UV ink are that they are not fast and cure thoroughly, they are easy to use and are not affected by small changes in ambient conditions, they retain constant viscosity (i.e., they do not dry up quickly), and they use smaller amounts of combustible organic solvent such that little or no solvent fumes escape into the working environment and are, therefore, environmentally safer. Small amounts of solvent may be added to the UV inks for certain applications to enable the ink to transfer in a conventional manner. The inks may optionally contain additives such as binders, reactive prepolymers, thinners, low-viscosity mono and poly-functional monomers, photoinitiators to stimulate polymerization, stabilizing additives, flow control agents, wetting agents, pigments, extenders, or combinations thereof. The thickness of the ink film transferred to the golf ball can be any thickness that is sufficient to provide a clear image of the indicia or logo. This thickness can be from about 4 to 50 um, preferably from about 4 to 20 um. The thickness of the ink film can vary with the ink type and color, and is also influenced by the ink's viscosity, the pad material, the depth of etching in the plate and also environmental factors such as temperature, humidity, and so on.

The term "about" as used herein in connection with one or more numbers or numerical ranges, should be understood to refer to all such numbers, including all numbers in a range.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those of ordinary skill in the art from the foregoing description. Such modifications are also intended to fall within the scope of the appended claims

We claim:

1. A method for printing of indicia on a golf ball, the method comprising: providing to an orientation system a golf ball having a dimpled pattern trajectory;

analyzing the dimpled pattern trajectory by a computer using a single communications transaction via Ethernet to orient the ball to a predetermined orientation;

providing a conveyor having a plurality of magnetic indexing devices, each device attached to a sled on the conveyor;

indexing the device to a first position using a station lock integral with the conveyor;

opening a hemispherical cavity cup of the device using means to push open a pair of flexible fingers, a finger on each side of the cavity cup;

transferring the oriented ball into the opened cavity cup;

verifying the orientation of the ball in the device with a first vision inspection system;

removing the ball from the device if the ball fails the first inspection;

indexing the device to a next position using another station lock;

printing a first set of indicia on up to three ball surface areas using UV curable ink;

indexing the device to a next position using another station lock;

printing a second set of indicia on up to two new ball surface areas using UV curable ink;

indexing the device by yet another station lock to place the printing of the up to three ball surface areas in visual focus of a second vision inspection system;

inspecting the printing of the up to three ball surfaces using the second vision inspection system;

indexing the device to the next position by another station lock to place the printing of the up to two ball surfaces in visual focus of the second vision inspection system;

inspecting the printing of the up to two ball surfaces using the second vision print quality inspection system;

indexing the device by another station lock to place the up to three ball surfaces in view of a UV curing light:

curing with UV radiation the ink of the printed up to three ball surfaces;

indexing the device by another station lock to place the up to two ball surfaces in view of the UV curing light;

curing with UV radiation the ink of the printed up to two ball surfaces;

indexing the device by another station lock, wherein the ball is rejected if a signal received from the second vision print quality inspection system indicates that the ball failed inspection.

2. The method of claim 1, wherein the printing is done by articulated pad prints with the UV curable ink supplied to each head by an ink viscosity control system.

3. The method of claim 1, wherein the indexing comprises each of the station locks to have a cam surface that intermeshes with an open bridge section of the magnetic indexing device to cause the device to turn 45° or 90°.

4. The method of claim 1, wherein each magnetic indexing device comprises:

a stationary base portion connected to the sled on the conveyor and a rotating cup portion magnetically connected to the base portion;

means for substantially friction-free rotation between the base and cup portions; and means for receiving and holding the golf ball in the cup portion, wherein the cup portion is caused to be rotated in relationship to the base portion by the station locks which biasly index the cup portion for each printing, inspection, curing, and ball removal procedure.

5. An apparatus for automatically printing indicia of the surface of a golf ball, the apparatus comprising:

a hopper for loading a multitude of golf balls to be printed thereupon;

a lifter for conveying each golf ball to an orientation system;

the orientation system comprising an imaging station wherein software loads a complete pattern trajectory of the ball to a computer with a single communications transaction via Ethernet;

a conveyor having a plurality of movable sleds integrally attached;

a plurality of magnetic rotating indexing devices, each device connected to one of the plurality of sleds;

a pair of parallel sliders comprising a left slider and a right slider, each slider having means for opening a hemispherical cavity of the magnetic rotating indexing device;

a transfer robotic mechanism that plucks an oriented ball from the orientation system and deposits the ball onto one of the magnetic rotating indexing devices;

a plurality of station locks, each having cam surfaces to index the rotating indexing devices to a predetermined position;

a plurality of articulated printer pad heads utilizing ultraviolet ("UV") curable inks to print indicia and logo on multiple surfaces of each ball;

first and second vision inspection systems wherein the first system inspects for proper ball orientation and the second system inspects for proper printing; and an ultraviolet curing system for fast drying of the printed indicia and logo.

6. The apparatus of claim 5, wherein the plurality of magnetic rotating indexing devices each comprise:

a stationary base portion connected to the sled on the conveyor and a rotating cup portion magnetically connected to the base portion;

means for substantially friction-free rotation between the base and cup portions;

means for creating an open bridge section for intermeshing with the cam surfaces of the station locks to cause the cup portion of the device to rotate; and a hemispherical cavity defined in the upper section of the device, each cavity having a pair of flexible fingers that can be pushed open by the sliders to allow the depositing of a golf ball.

7. The apparatus of claim 6, wherein the left and right sliders are mirror images of each other, each slider comprising:

a slide base anchored to the conveyor;

a slide table mounted to the base;

a pusher element reciprocally slides back and forth, the pusher element having contact tips that engage and push the flexible fingers of the hemispherical cavity which causes the fingers to spread apart and therein create an open position for the depositing of a golf ball.

8. The apparatus of claim 7, wherein the plurality of station locks each comprise an engaging cam surface for intermeshing with the open bridge section of the device to cause the device to index either 45° or 90°.

9. The apparatus of claim 8, wherein the number of station locks on the conveyor are eight.

10. The apparatus of claim 6, wherein the substantially friction-free rotation means of the device portions comprises:

a plurality of recesses defined in the upper surface of the base portion, each recess containing a bottom magnet therein;

a circular channel defined on the top surface of the base portion;

a bottom metallic washer ring seated in the channel and held in place by the magnetic force generated by the bottom magnets;

a thrust bearing ring juxtaposed on top of the bottom washer ring and held by the magnetic force;

a metallic top washer held by magnetic force to a bottom surface of a lower circular member juxtaposed against a top surface of the thrust bearing ring therein magnetically locking the base and rotating cup portions to each other, wherein when the rotating cup portion is biasly indexed in relationship to the base portion, the cup portion glides virtually friction-free over the thrust bearing ring.

11. The apparatus of claim 6, wherein the means for creating an open bridge section comprises:

a circular upper member supporting a main body of the rotating cup portion; the upper member connected to a lower circular member by a plurality of shoulder bolts threaded into a bottom surface of the upper member and unthreaded sections of the bolts provide spacing between the lower and upper circular members to create a bridge-like opening, wherein the cam surfaces of the station locks intermesh with the open bridge section to cause the cup portion to rotate in relationship to the base portion.

* * * * *